US007491018B2

(12) United States Patent
Freitag et al.

(10) Patent No.: US 7,491,018 B2
(45) **Date of Patent: *Feb. 17, 2009**

(54) STABILIZED SOIL STRUCTURE AND FACING ELEMENTS FOR ITS CONSTRUCTION

(75) Inventors: Nicolas Freitag, Orsay (FR); Jean-Claude Morizot, Paris (FR)

(73) Assignee: Freyssinet International (STUP) (FR)

( * ) Notice: Subject to any disclaimer, the term of this patent is extended or adjusted under 35 U.S.C. 154(b) by 749 days.

This patent is subject to a terminal disclaimer.

(21) Appl. No.: 11/072,954

(22) Filed: Mar. 3, 2005

(65) Prior Publication Data

US 2006/0110221 A1 May 25, 2006

(30) Foreign Application Priority Data

Nov. 25, 2004 (FR) ..... 04 12528

(51) Int. Cl.
*E02D 29/02* (2006.01)

(52) U.S. Cl. ..... 405/262; 405/284; 405/286

(58) Field of Classification Search ..... 405/262, 405/284, 285, 286

See application file for complete search history.

(56) References Cited

U.S. PATENT DOCUMENTS 4,273,476 A * 6/1981 Kotulla et al. ..... 405/284
4,343,571 A * 8/1982 Price ..... 405/284
4,470,728 A 9/1984 Broadbent
4,671,706 A 6/1987 Giardini
4,824,293 A * 4/1989 Brown et al. ..... 405/284
5,484,235 A 1/1996 Hilfiker et al.
5,816,749 A 10/1998 Balley, II
5,839,855 A * 11/1998 Anderson et al. ..... 405/262
6,079,908 A 6/2000 Anderson
6,443,662 B1 * 9/2002 Scales et al. ..... 405/262
6,443,663 B1 * 9/2002 Scales et al. ..... 405/262
6,447,211 B1 * 9/2002 Scales et al. ..... 405/262
6,447,212 B2 * 9/2002 Orsat ..... 405/262
6,468,004 B1 * 10/2002 Price ..... 405/262
2001/0014255 A1 8/2001 Orsat
2006/0171783 A1 * 8/2006 Freitag et al. ..... 405/262

FOREIGN PATENT DOCUMENTS

FR 2 812 893 2/2002

* cited by examiner

*Primary Examiner*—Frederick L Lagman
(74) *Attorney, Agent, or Firm*—Banner & Witcoff

(57) ABSTRACT

The facing element for a stabilized soil structure comprises a body of cast material inside which a path is formed for a reinforcement strip between two points of emergence situated on a rear face of the element. This path includes two rectilinear portions which are respectively adjacent to the two points of emergence and are each arranged so as to position the strip in the same plane of emergence perpendicular to the rear face, two curved portions which respectively continue the two rectilinear portions and are arranged so as to deviate the strip from the plane of emergence, and a connection portion which joins the two curved portions to one another and has at least one loop situated outside the plane of emergence.

15 Claims, 4 Drawing Sheets

FIG. 6.
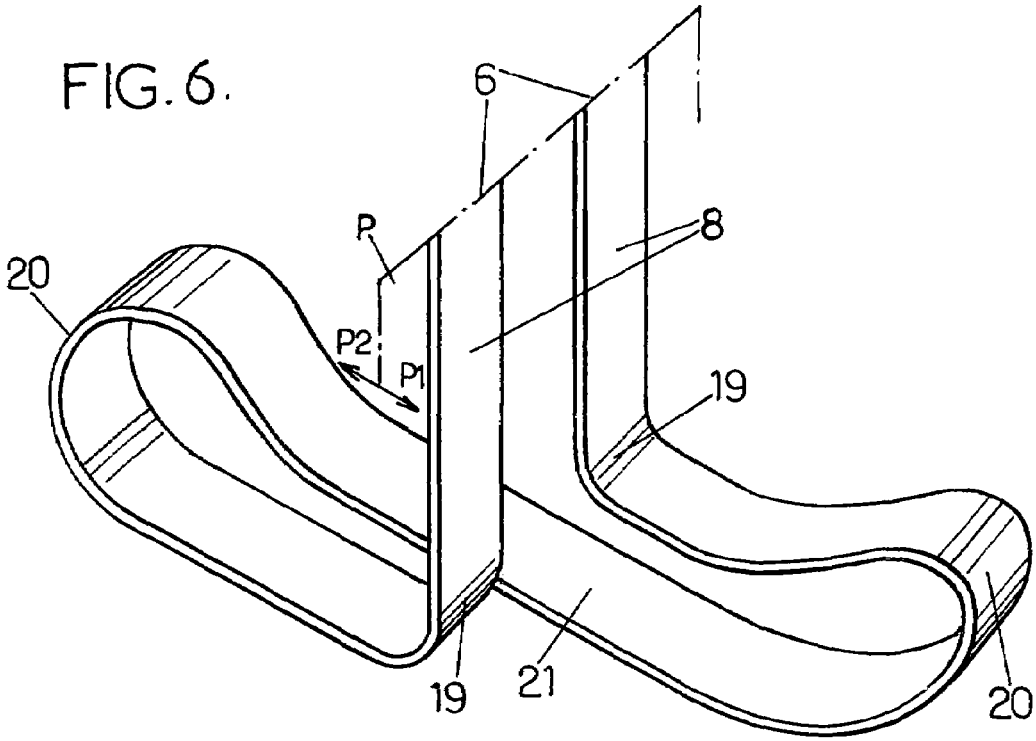
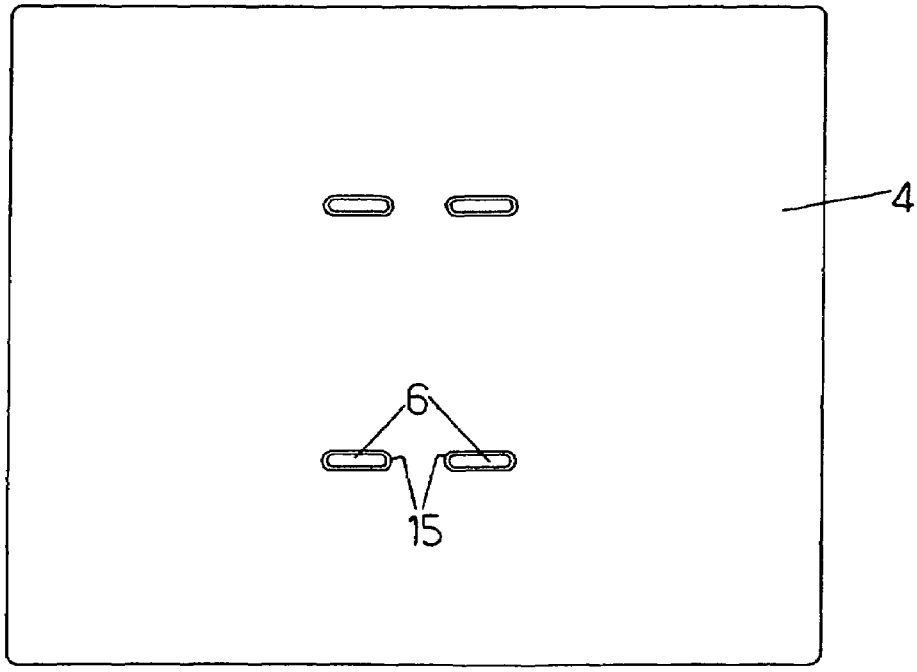
FIG. 7.

STABILIZED SOIL STRUCTURE AND FACING ELEMENTS FOR ITS CONSTRUCTION

BACKGROUND OF THE INVENTION

In a principal aspect the present invention relates to the construction of stabilized soil or reinforced earth structures. This building technique is commonly used to produce structures such as retaining walls, bridge abutments, etc.

A stabilized soil structure combines a compacted fill, a facing, and reinforcements usually connected to the facing. The reinforcements are placed in the soil with a density dependent on the stresses that might be exerted on the structure, the thrust forces of the soil being reacted by the soil-reinforcements friction.

The invention more particularly concerns the case where the reinforcements are in the form of strips of synthetic material, for example based on polyester fibres.

The facing is most often made up of prefabricated concrete elements, in the form of slabs or blocks, juxtaposed to cover the front face of the structure. There may be horizontal steps on this front face between different levels of the facing, when the structure has one or more terraces.

The reinforcements placed in the fill are usually secured to the facing by mechanical connecting members that may take various forms. Once the structure is complete, the reinforcements distributed through the fill transmit high loads, in some cases of up to several tonnes. Their connection to the facing needs to be robust in order to maintain the cohesion of the whole.

The connecting members exhibit risks of degradation. They are often sensitive to corrosion due to moisture or to chemical agents which are present in or which have infiltrated into the fill. The connecting members are sometimes made on the basis of resins or composite materials so that they corrode less readily. However, their cost is then increased, and it is difficult to give them good mechanical properties. It is therefore desirable to be able to dispense with connecting members between the facing element and the reinforcements of the structure.

In some systems, the facing elements are configured in such a way as to present at least one passage intended to receive a reinforcement strip.

In U.S. Pat. No. 5,839,855, the passage is in the shape of a C within the thickness of the facing element in the form of a panel. When the strip is put in place, its two sections emerging from the facing element are located in two parallel horizontal planes offset in the vertical direction. This condition of emergence of the strips from the panel is not ideal because it makes it necessary to increase the number of filling and compacting operations, which complicates and prolongs the implementation of the work. This does not easily permit homogeneous tensioning of the strips, because the strip is not retained by the panel when its lower portion is covered with fill.

For these reasons, it is generally desirable for the strips to emerge from the facing element in the same horizontal plane.

In addition, the C-shaped path of the reinforcement strips is not optimal in terms of the robustness of the anchoring when stressed. The curve of the path near the point of emergence of the strip weakens its anchoring to the element because it causes working in tension of a small thickness of concrete, which is not a good way of stressing this material.

A similar problem arises with a facing element of the type described in FR-A-2 812 893. This element also has a preformed path in the shape of a C. In addition, this C-shaped path is arranged so that each portion of the reinforcement strip emerges from the element oriented in a vertical plane. This is unsatisfactory because the strip placed on the ground positions itself naturally in a horizontal plane, so that each portion of the strip in the fill twists one quarter of a turn. Such twisting is unfavourable in terms of the mechanical behaviour of the reinforcement.

It is an object of the present invention to propose a novel method of anchoring reinforcement strips to a facing of a stabilized soil structure, making it possible to reduce the incidence of the problems set out above.

SUMMARY OF THE INVENTION

Briefly, the invention thus proposes a stabilized soil structure, comprising a fill, reinforcement strips extending through a reinforced zone of the fill situated behind a front face of the structure, and a facing placed along said front face, the reinforcement strips being anchored to the facing in respective anchoring regions. In at least one anchoring region, the facing incorporates a path formed for a reinforcement strip between two points of emergence situated on a rear face of the facing adjacent to the fill. This path includes two rectilinear portions respectively adjacent to the two points of emergence and each arranged to position the strip in a common plane of emergence perpendicular to said rear face, two curved portions respectively continuing the two rectilinear portions and arranged to deviate the strip from the plane of emergence, and a connection portion joining the two curved portions to one another and having at least one loop situated outside the plane of emergence.

The fact that the loop of the strip inside the facing is offset outside the plane of emergence allows this strip to penetrate into the thickness of the facing while remaining oriented in this plane down to a certain depth. This ensures good guiding of the strips as they emerge from the facing and avoids inappropriate stressing of the cast material (generally concrete). This permits good positioning and effective anchoring of the reinforcement strip while ensuring that it does not follow excessively sharp curves and avoiding to subject it to high contraction forces.

The rectilinear portions of said path preferably each extend in the plane of emergence by at least half the thickness of the facing. The reinforcement strip typically has a width at most equal to half the thickness of the facing.

In one embodiment of the structure, the facing has, in the anchoring region, a protective sheath receiving the reinforcement strip along said path. This sheath separates the strip from the cast material so as to protect the reinforcement against premature damage. In particular, if the reinforcement is obtained using polyester fibres, it is known that these poorly tolerate alkaline environments such as those found in concrete. The aforementioned sheath thus complements the protection conferred by the plastic coating on the polyester fibres of the strip.

A second aspect of the invention concerns a facing element for a stabilized soil structure, comprising a body of cast material inside which a path is formed for a reinforcement strip between two points of emergence situated on a rear face of the body. The path includes two rectilinear portions respectively adjacent to the two points of emergence and each arranged to position the strip in a common plane of emergence perpendicular to said rear face, two curved portions respectively continuing the two rectilinear portions and arranged to deviate the strip from the plane of emergence, and a connection portion joining the two curved portions to one another and having at least one loop situated outside the plane of emergence.

The strip can be put in place in the path at the time the material of the body is cast, with or without the above-mentioned protective sheath.

Various configurations are possible for the path defined for the strip within the facing element. In some embodiments, the two curved portions of the path direct the strip towards a common side of the plane of emergence. In this case, a first possibility is for the path to be formed so as to receive the strip in the two rectilinear portions with the same face of the strip oriented towards this side of the plane of emergence. The path is thus formed so that said face of the strip is placed either on the outer side or on the inner side of the loop situated outside the plane of emergence. A second possibility is for the path to be formed so as to receive the strip in one of the two rectilinear portions with one face of the strip oriented towards said side of the plane of emergence and in the other of the two rectilinear portions with said face of the strip oriented away from said side of the plane of emergence.

In another embodiment, the two curved portions of the path respectively direct the strip towards two opposite sides of the plane of emergence, and the connection portion of the path has two loops which respectively continue the two curved portions of the path, and a part which crosses the plane of emergence and joins the two loops to one another.

BRIEF DESCRIPTION OF THE DRAWING

In the detailed description which follows, reference will be made to the drawing comprised of the following figures:

FIGS. 3 to 6 are perspective views of paths that reinforcement strips may follow within facing elements according to the invention.

FIG. 7 is a rear view of another facing element according to the invention.

DESCRIPTION OF THE PREFERRED EMBODIMENT

Figure 1:
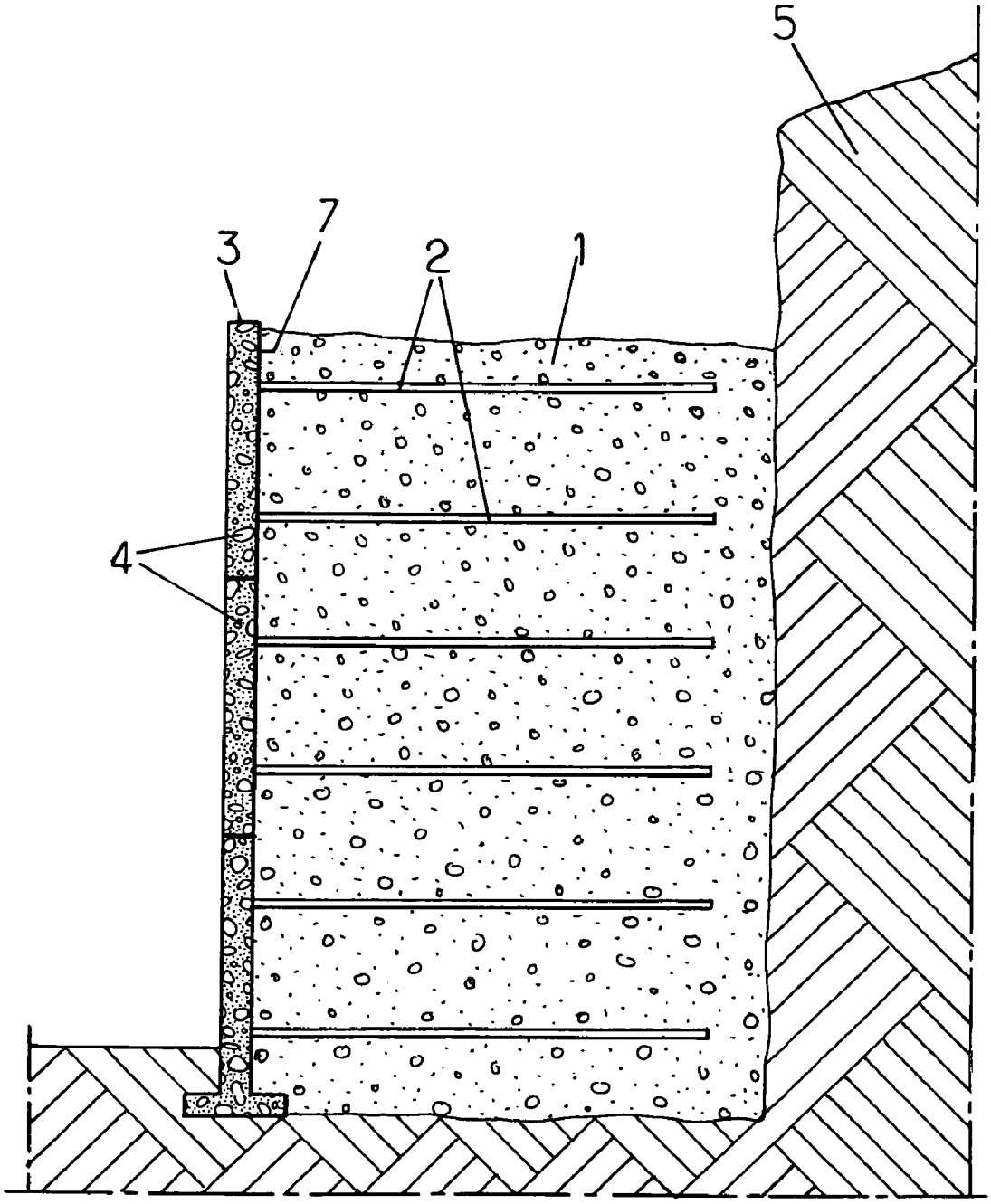
FIG. 1 is a is a schematic view in lateral section of a stabilized soil structure according to the invention in the process of being built.

Referring to the figures, FIG. 1 illustrates the application of the invention to the building of a stabilized soil retaining wall. A compacted fill 1, in which reinforcements 2 are distributed, is delimited on the front side of the structure by a facing 3 formed by juxtaposing prefabricated elements 4 in the form of panels, and on the rear side by the soil 5 against which the retaining wall is erected.

The reinforcements 2 comprise synthetic reinforcing members in the form of flexible strips extending in horizontal planes behind the facing 3. These may in particular be reinforcement strips based on polyester fibres encased in polyethylene.

The reinforcement strips 2 are attached to the prefabricated elements 4 joined together to form the facing 3. These elements 4 are typically made of reinforced concrete. In the example shown, they are in the form of panels. They could also have other forms, in particular the form of blocks. When the concrete of such an element 4 is cast, one or more reinforcement strips 2 are installed in the mould, along a path described below, to provide the strip-element anchorage.

After the concrete has set, each strip has two sections which emerge from the element and are to be installed in the fill material.

For erecting the structure, the procedure may be as follows:

a) Placing some of the facing elements 4 so as then to be able to introduce fill material over a certain depth. In a known manner, the erection and positioning of the facing elements may be made easier by assembly members placed between them. The strips 2 are so positioned on the facing elements 4 that some of them are located at the same horizontal level when the facing is erected.

b) Introducing fill material and compacting it progressively until the next specified level for placement of the reinforcement strips 2 is reached.

c) Laying the reinforcement strips 2 on the fill at this level.

d) Introducing fill material over the reinforcement strips 2 which have just been installed. This fill material is compacted as it is introduced.

e) Repeating steps b) to d) if several levels of strips are provided per series of facing elements 4.

f) Repeating steps a) to e) until the upper level of the fill is reached. For erecting the structure, the procedure may be as follows:

During introduction and compacting of the fill material, the reinforcement strips 2 already placed at the lower levels experience tensioning. This tensioning results from the friction between the strips and the filled material and ensures the reinforcement of the structure. So that the tension is established under good conditions, it is advisable that the strips of one level emerge from their facing elements so that they are all correctly aligned with this level. It is also advisable that they are oriented horizontally as they emerge from the facing, so as to ensure that they do not twist in the filled material.

Figure 2:
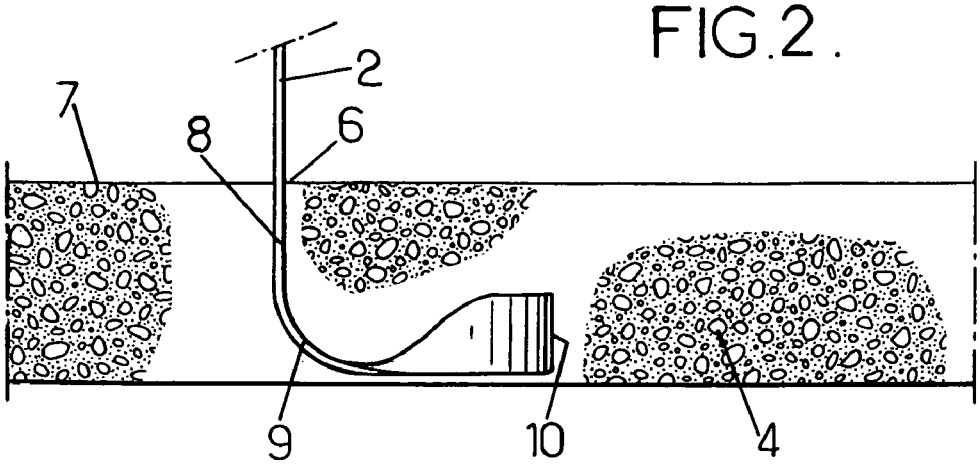
FIG. 2 is a cross-sectional view of a facing element according to the invention.

At their points of emergence 6 from a facing element, the two sections of a strip 2 are in a common plane of emergence P (perpendicular to the plane of FIG. 2). When the facing 3 is erected, the elements 4 are so oriented that this plane of emergence is horizontal.

FIG. 2 shows a facing element that can be used in some embodiments of the invention. As is customary, this element 4 is made of cast concrete. A reinforcement strip 2 is placed in the mould at the moment of casting the concrete therein and is maintained in place until the concrete has set. It can be guided with the aid of the reinforcing bars (not shown) of the concrete, optionally complemented by deviator rods or members fixed to these bars, so that the strip follows the desired path in the anchoring zone. This path is defined inside the element 4 between the two points of emergence 6 of the two portions of the strip on the rear face 7 of the element (face adjacent to the fill).

Figure 3:
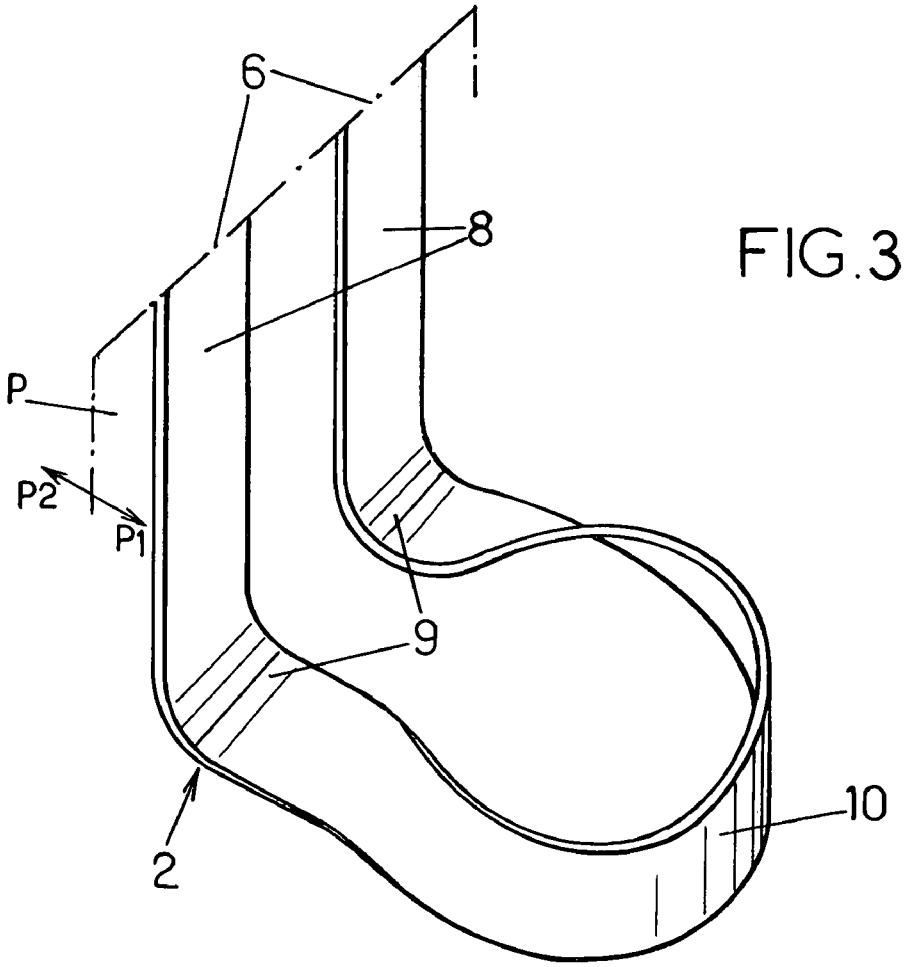

The path corresponding to the element in FIG. 2 is illustrated by FIG. 3. It has two rectilinear portions 8 extending perpendicular to the rear face 7 of the element starting from the points of emergence 6. In each rectilinear portion 8, the strip remains in its plane of emergence P. The rectilinear portions 8 extend by at least half the thickness of the body of the element 4, measured perpendicular to its rear face 7. This avoids undesired stressing of the concrete near the rear face 7.

Each rectilinear portion 8 of the path of the strip is continued by a respective curved portion 9 where the strip deviates from the plane of emergence P. Beyond this curved portion 9, the strip 2 extends along the front face of the element, set back slightly from this front face so as not to be noticeable at the surface of the structure.

The two curved portions 9 are joined to one another by a connection portion which has a loop 10 situated outside the plane of emergence P.

In the example in FIGS. 2 and 3, the strip is directed towards the same side P1 of the plane of emergence P in the two curved portions 9 of its path inside the facing element 4. This path is formed in such a way (i) that, in the two rectilinear portions 8, the strip has the same face oriented towards the side P1 of the plane of emergence, and (ii) that this face of the strip is placed on the outer side of the loop 10. Consequently, at the middle of the loop 10, the strip is positioned practically perpendicular to the rear face 7 of the element.

Figure 4:
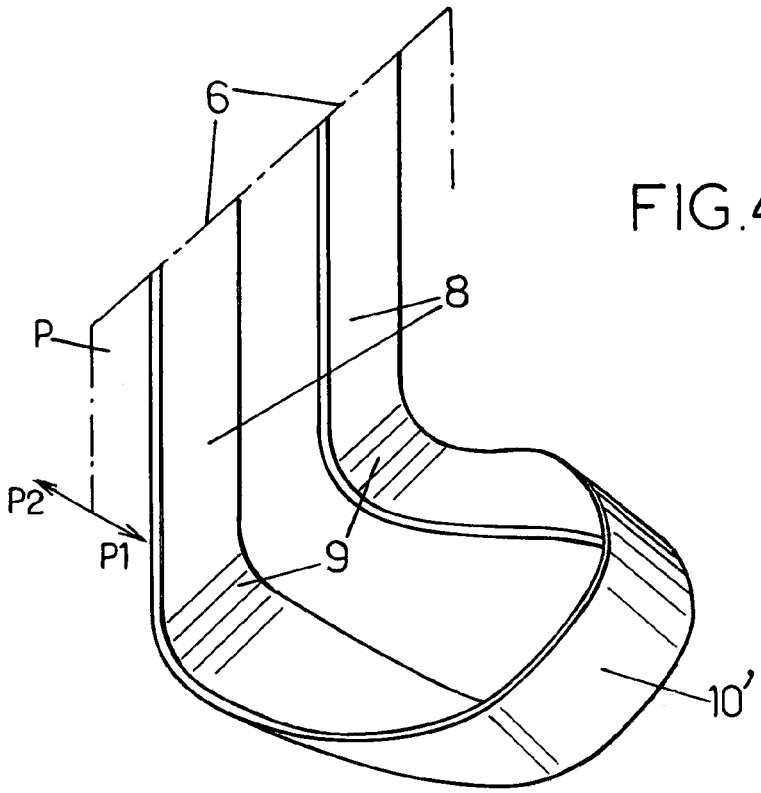

In the alternative embodiment illustrated in FIG. 4, the loop 10' is oriented in the opposite direction, i.e. the face of the strip oriented towards the side P1 of the plane of emergence is placed on the inner side of the loop 10'.

Figure 5:
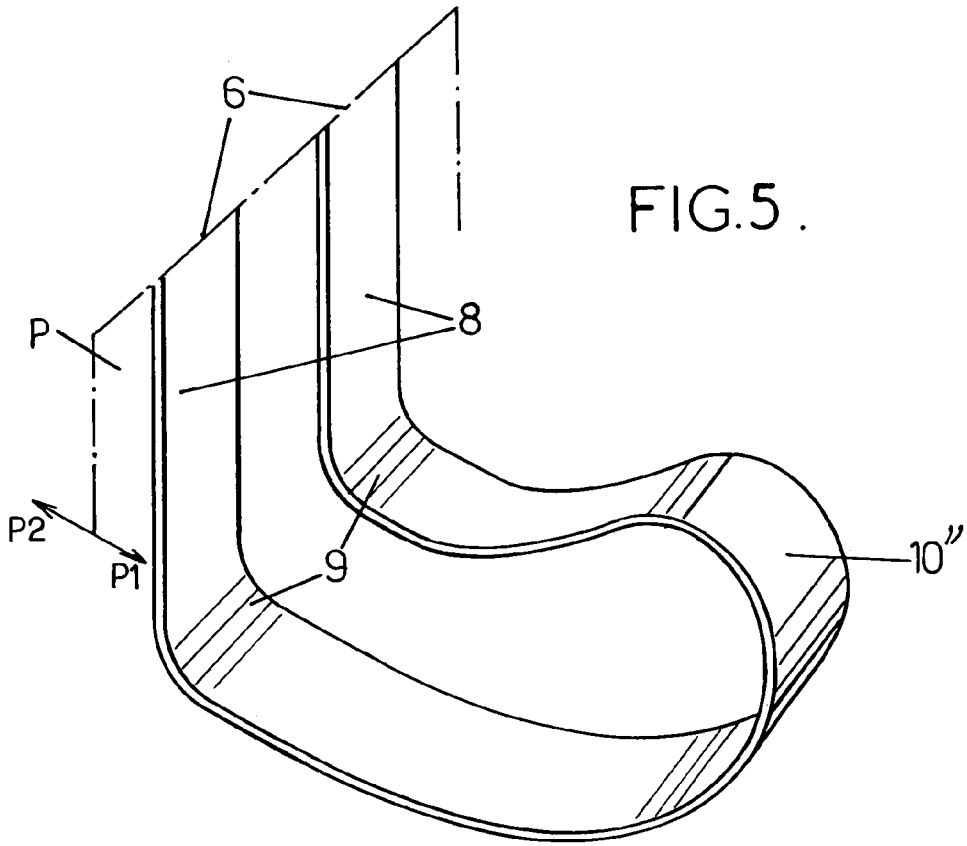

In the alternative embodiment illustrated in FIG. 5, the strip follows one of the two rectilinear portions 8 of its path with one of its two faces oriented towards the side P1 of the plane of emergence P and with the other one of the two rectilinear portions 8 having said face oriented towards the side P2 of the plane of emergence opposite from side P1.

Other configurations are also possible for the path followed by the reinforcement strip inside a facing element. FIG. 6 shows an example in which the connection portion joining the two curved portions 19 to one another includes two loops 20 on each side of the plane P. In this example, the two curved portions 19 of the path respectively direct the strip towards the opposite two sides P1, P2 of the plane of emergence P. The connection portion has a part 21 which crosses the plane P and joins the two loops 20 to one another.

In order to easily follow a path such as the ones illustrated in FIGS. 3 to 6, it is preferable that the width of the strip 2 is less than or at most equal to half the thickness of the facing element 4. This thickness is typically between 14 and 16 cm. It will be possible to use strips having a width of about 45 mm.

When the reinforcement strip has components (for example polyester fibres) sensitive to alkaline environments, it may be advantageous to place a protective sheath made of plastic between this strip and the concrete facing. This sheath ensures that the alkalinity of the concrete does not propagate down to the sensitive component. The flexible sheath receives the strip before being placed together with it in the mould. It is thus surrounded by the poured concrete and it receives the reinforcement strip along its path in order to separate it from the concrete.

It is conceivable that the reinforcement strip is not yet fitted in its sheath 15 at the time the element is produced. It is thus convenient to use a rigid sheath that has been shaped beforehand to the desired path. FIG. 7 shows the rear face of a facing element 4 formed in this way and capable of receiving two reinforcement strips at vertically spaced levels. The sheaths 15 define the paths inside the element 4 between the points of emergence 6. They can be pre-formed rigid sheaths, for example according to one of the shapes illustrated in FIGS. 3 to 6.

A configuration according to FIG. 7 requires an operation of threading the strips along their paths. However, it has the advantage of making it possible to choose the strip length independently of the production of the facing element.

Generally speaking, the proposed method of connection, between the facing of a stabilized soil structure and at least some of its reinforcement strips, is compatible with a large number of structural configurations, strip lengths, strip positioning densities, etc.

What is claimed is:

1. A stabilized soil structure, comprising fill reinforcement strips extending through a reinforced zone of the fill situated behind a front face of the structure, and a facing placed along said front face, the reinforcement strips being anchored to the facing in respective anchoring regions, wherein the facing incorporates, in at least one anchoring region, a path formed for a reinforcement strip between two points of emergence situated on a rear face of the facing adjacent to the fill, and wherein said path includes two rectilinear portions respectively adjacent to the two points of emergence and each arranged to position the strip in a common plane of emergence perpendicular to said rear face, two curved portions respectively continuing the two rectilinear portions and arranged to deviate the strip from the plane of emergence, and a connection portion joining the two curved portions to one another and having at least one loop situated outside the plane of emergence.

2. The structure of claim 1, wherein the facing is made from elements in the form of panels, and wherein the rectilinear portions of said path each extend in the plane of emergence by at least half the thickness of a panel-shaped facing element.

3. The structure of claim 1, wherein the reinforcement strip has a width at most equal to half a thickness of the facing.

4. The structure of claim 1, wherein the facing has, in the anchoring region, a protective sheath receiving the reinforcement strip along said path.

5. A facing element for a stabilized soil structure, comprising a body of cast material having a path formed therein for a reinforcement strip between two points of emergence situated on a rear face of the body, wherein the path includes two rectilinear portions respectively adjacent to the two points of emergence and each arranged to position the strip in a common plane of emergence perpendicular to said rear face, two curved portions respectively continuing the two rectilinear portions and arranged to deviate the strip from the plane of emergence, and a connection portion joining the two curved portions to one another and having at least one loop situated outside the plane of emergence.

6. The facing element of claim 5, wherein the body is in the form of a panel, and wherein the rectilinear portions of said path each extend in the plane of emergence by at least half a thickness of the body, measured perpendicular to the rear face.

7. The facing element of claim 5, wherein the body has, perpendicular to the rear face, a thickness at least equal to twice a width of the reinforcement strip.

8. The facing element of claim 5, further comprising a protective sheath surrounded by the cast material of the body, in order to receive the reinforcement strip along said path and separate the strip from the cast material.

9. The facing element of claim 8, wherein the strip is not installed in the sheath at the time the element is produced.

10. The facing element of claim 5, wherein the strip is placed in said path when the material of the body is cast.

11. The facing element of claim 5, wherein the two curved portions of the path direct the strip towards a common side of the plane of emergence, and wherein said path is so formed that the strip is received in the two rectilinear portions with a common face of the strip oriented towards said side of the plane of emergence.

12. The facing element of claim 11, wherein said path is so formed that said face of the strip is placed on an outer side of the loop situated outside the plane of emergence.

13. The facing element of claim 11, wherein said path is so formed that said face of the strip is placed on an inner side of the loop situated outside the plane of emergence.

14. The facing element of claim 5, wherein the two curved portions of the path direct the strip towards a common side of the plane of emergence, and wherein said path is so formed that the strip is received in one of the two rectilinear portions with one face of the strip oriented towards said side of the plane of emergence and in the other one of the two rectilinear portions with said face of the strip oriented away from said side of the plane of emergence.

15. The facing element of claim 5, wherein the two curved portions of the path respectively direct the strip towards two opposite sides of the plane of emergence, and wherein said connection portion has two loops respectively continuing the two curved portions of the path, and a part crossing the plane of emergence and joining the two loops to one another.

* * * * *